US012630356B2

(12) United States Patent
Schlatter

(10) Patent No.: US 12,630,356 B2
(45) Date of Patent: May 19, 2026

(54) GAUGE HATCH WITH SPRING COMPRESSOR

(71) Applicant: Jayco Vent Valve, Inc., Oklahoma City, OK (US)

(72) Inventor: William L. Schlatter, Oklahoma City, OK (US)

(73) Assignee: Jayco Vent Valve, Inc., Oklahoma City, OK (US)

( * ) Notice: Subject to any disclaimer, the term of this patent is extended or adjusted under 35 U.S.C. 154(b) by 58 days.

(21) Appl. No.: 18/753,684

(22) Filed: Jun. 25, 2024

(65) Prior Publication Data

US 2025/0388390 A1 Dec. 25, 2025

(51) Int. Cl.
*B65D 90/10* (2006.01)

(52) U.S. Cl.
CPC ..... *B65D 90/10* (2013.01)

(58) Field of Classification Search
CPC ..... Y10T 292/202; F17C 2205/0332; B65D 90/48; B65D 90/10; B63B 25/00; B63B 19/14; B63B 19/12
See application file for complete search history.

(56) References Cited

U.S. PATENT DOCUMENTS

| | | | | |
|---|---|---|---|---|
| 1,753,024 | A | 4/1930 | Rode | |
| 2,061,094 | A | 11/1936 | Thomas | |
| 2,288,230 | A | 6/1942 | Drane | |
| 2,599,072 | A * | 6/1952 | Schweiso | A47J 27/0811 220/316 |
| 3,559,587 | A | 2/1971 | Jones | |
| 3,844,597 | A * | 10/1974 | Elrod | F16J 13/24 292/136 |
| 3,965,916 | A | 6/1976 | Karas | |
| 4,414,605 | A | 11/1983 | Chino et al. | |
| 4,654,944 | A | 4/1987 | Graf | |
| 4,953,583 | A | 9/1990 | Szlaga | |
| 7,814,629 | B2 | 10/2010 | Uzun | |
| 9,739,390 | B2 | 8/2017 | Kayser | |
| 9,764,893 | B1 | 9/2017 | Westmoreland, III | |
| 10,724,638 | B2 | 7/2020 | Bartha et al. | |

(Continued)

FOREIGN PATENT DOCUMENTS

KR 101895063 B1 9/2018

OTHER PUBLICATIONS

International Search Report and Written Opinion dated Oct. 30, 2025; PCT/US2025/034604; 11 pgs.

*Primary Examiner* — Kareen K Thomas
(74) *Attorney, Agent, or Firm* — Dunlap Codding, P.C.

(57) ABSTRACT

A gauge hatch has a base with an opening and an annular seal surface, a lid having a body and a pusher, a plunger positioned between the base and the lid and having an annular seal surface, a pressure seal member supported by a plunger, and a vacuum seal member supported by the plunger. The pressure spring positioned between the pusher and the plunger and the pusher movably mounted to the body so the pusher is movable between a first position wherein the pressure seal is sealingly disengaged from the annular seal surface of the base and the pressure spring is in a substantially non-compressed condition, and a second position wherein the pressure seal member is sealingly engaged with the annular seal surface of the base and the pressure spring is in a compressed condition.

18 Claims, 8 Drawing Sheets

(56) References Cited

U.S. PATENT DOCUMENTS

| | | | | |
|---|---|---|---|---|
| 2005/0166458 | A1* | 8/2005 | McKenzie | B65D 90/10 49/394 |
| 2010/0084365 | A1 | 4/2010 | Liu | |
| 2013/0264341 | A1 | 10/2013 | Cockerham et al. | |
| 2016/0001935 | A1* | 1/2016 | Smith | B65D 43/167 220/327 |
| 2016/0288994 | A1* | 10/2016 | Lorenzen | B65D 90/10 |
| 2018/0274284 | A1 | 9/2018 | Bartha et al. | |
| 2021/0061552 | A1 | 3/2021 | Schunk | |

* cited by examiner

GAUGE HATCH WITH SPRING COMPRESSOR

BACKGROUND

A gauge hatch, also called a thief hatch, is an access port typically found on the top of storage tanks or vessels used in various industries such as oil and gas, chemical processing, and water treatment. They are located on the top of the tank or vessel, providing access to the interior for inspection, sampling, and measurement purposes. Gauge hatches have a lid hinged to a base for opening and closing the access port.

Some gauge hatches regulate pressure in a tank by releasing pressure when the tank pressure exceeds a high-pressure threshold and introducing pressure into the tank when the pressure drops below a vacuum pressure threshold (e.g., a negative pressure threshold relative to the ambient atmosphere). When the tank pressure is between the high-pressure threshold and the vacuum pressure threshold, two seal assemblies in the closed hatch reduce (e.g., prevent) leakage of vapors from the tank. While suitable for any application, such pressure-regulating hatches are often implemented on tanks where volatile and vaporizable liquids are stored, transported, or otherwise handled.

A pressure seal assembly that regulates pressure release from the tank typically includes a compression spring that biases a pressure seal member against a seal surface. A vacuum seal assembly that regulates the introduction of pressure into the tank includes a tension spring that biases a vacuum seal member against a second seal surface. The spring tensions can be varied depending on the applications and pressures encountered. For example, pressure springs may be used that vary in strength from 4 oz. to 32 oz. Recently, there has been a desire to use stiffer compression springs to regulate pressure release from the tank and decrease the release of volatile substances into the atmosphere.

The compression spring is compressed to bias the seal against the seal surface as the hatch lid is moved to the closed position. Problems encountered when using a larger and stiffer compression spring are that it is difficult to install the spring and to close the lid due to the resistance of the compression spring. Because the lid is hinged to the base, another problem is that as the lid is closed, the pressure seal member contacts the seal surface in a misaligned relationship that can result in damage to the seal.

To this end, an improved gauge hatch with a spring compressor is needed to facilitate the operation of the hatch and to ensure a quality seal. The inventive concepts disclosed herein are directed to such an improved gauge hatch.

DETAILED DESCRIPTION OF EXEMPLARY EMBODIMENTS

Figure 1:
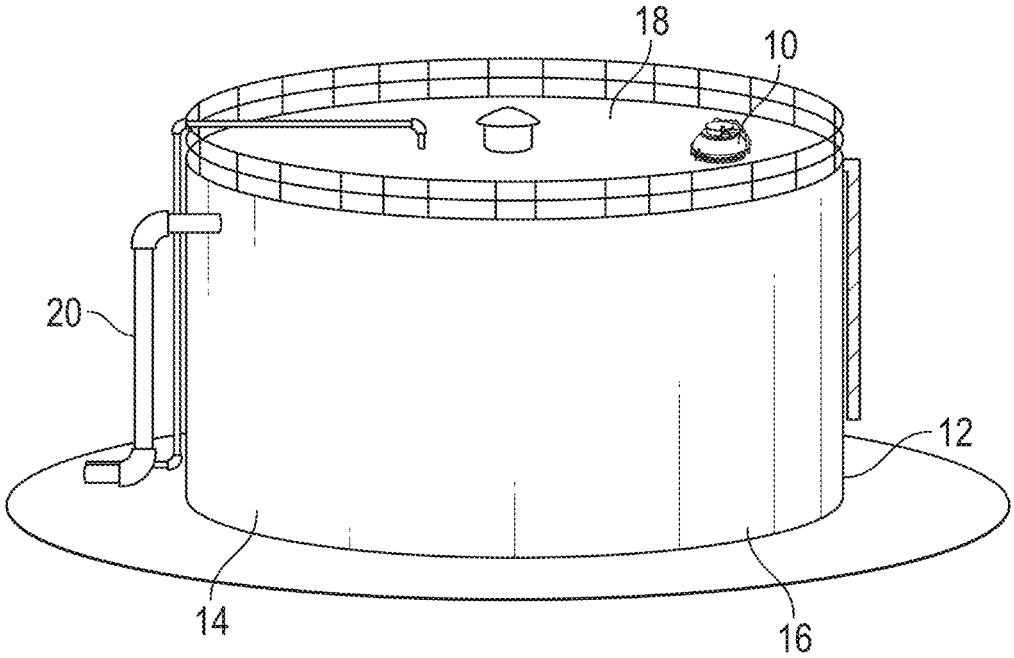
FIG. 1 is a perspective view of an exemplary storage tank with a gauge hatch constructed in accordance with the inventive concepts disclosed herein.

Before explaining at least one embodiment of the inventive concepts disclosed herein in detail, it is to be understood that the inventive concepts are not limited in their application to the details of construction and the arrangement of the components or steps or methodologies set forth in the following description or illustrated in the drawings. The inventive concepts disclosed herein are capable of other embodiments or being practiced or carried out in various ways. Also, it is to be understood that the phraseology and terminology employed herein are for the purpose of description and should not be regarded as limiting the inventive concepts disclosed and claimed herein in any way.

In the following detailed description of embodiments of the inventive concepts, numerous specific details are set forth to provide a more thorough understanding of the inventive concepts. However, it will be apparent to one of ordinary skill in the art that the inventive concepts within the instant disclosure may be practiced without these specific details. In other instances, well-known features have not been described in detail to avoid unnecessarily complicating the instant disclosure.

As used herein, the terms "comprises," "comprising," "includes," "including," "has," "having," and any variations thereof are intended to have a non-exclusive inclusion. For example, a process, method, article, or apparatus that comprises a list of elements is not necessarily limited to only those elements and may include other elements not expressly listed or inherently present therein.

Unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B is true (or present).

In addition, use of the "a" or "an" are employed to describe elements and components of the embodiments disclosed herein. This is done merely for convenience and to give a general sense of the inventive concepts. This description should be read to include one or at least one and the singular also includes the plural unless it is obvious that it is meant otherwise.

As used herein, qualifiers like "substantially," "about," "approximately," and combinations and variations thereof are intended to include not only the exact amount or value they qualify but also some slight deviations therefrom, which may be due to manufacturing tolerances, measurement error, wear and tear, stresses exerted on various parts, and combinations thereof, for example.

Finally, as used herein, any reference to "one embodiment" or "an embodiment" means that a particular element, feature, structure, or characteristic described in connection with the embodiment is included in at least one embodiment. The phrase "in one embodiment" appearing in various places in the specification does not necessarily refer to the same embodiment.

Referring now to the drawings, and more particularly to FIG. 1, a gauge hatch 10 constructed in accordance with the inventive concepts disclosed herein is illustrated mounted to an exemplary storage tank 12. The storage tank 12 is used for containing liquids and may be of any type, terrestrial, marine, rail, or truck, and constructed of virtually any industrial material, steel, fiberglass, and plastic being the most common. Storage tanks intended to contain liquid hydrocarbons (oil, crude oil, refined products, drip gas, etc.) that may produce volatile organic compounds (VOCs) are typically constructed of steel or fiberglass. Most storage tanks exhibit generic design features, such as that depicted in FIG. 1. These include an exterior shell 14 having continuous sides 16, a floor (not shown), and a roof 18 (some designs employ floating external or internal roofs) for containing liquid in its interior while preventing vapors, such as VOCs, from being vented into the atmosphere.

The gauge hatch 10 is mounted over a access opening (not shown) formed in the roof 18 of the storage tank 12, enabling tank operators to access the liquid. Generically, gauge hatches are also known in the petroleum industry as "thief hatches" because they allow tank operators to visually inspect and gauge the contents of the storage tank 12 and "thief" or sample the liquid stored within.

The storage tank 12 may be one component of a variety of components. In the illustrated examples, the storage tank 12 is coupled to an input device 20 that may pump or otherwise introduce a fluid into the storage tank 12. Similarly, the storage tank 12 is coupled to an output device (not shown) to withdraw fluid from the storage tank 12. The input and output devices may be any fluid handling, storage, and/or processing components or equipment that are operatively coupled to the storage tank 12 substantially permanently or on a selective, temporary, and/or intermittent basis.

When a fluid is stored in the storage tank 12, pressure may build within the storage tank 12. For example, the input device 20 may introduce fluid for storage into the storage tank 12 at an elevated pressure, or an elevated ambient temperature may cause the pressure inside the storage tank 12 to increase. As such, it may be desirable to vent or release pressure within an interior of the storage tank 12 above a threshold pressure (e.g., a high-pressure threshold). The gauge hatch 10 may be configured to open to allow fluid communication between the interior of the storage tank 12 and an ambient environment external to the storage tank 12. In particular, the gauge hatch 10 may have a pressure seal assembly configured to open to allow fluid communication between the interior of the storage tank 12 and the ambient environment surrounding the storage tank 12 when the pressure within the interior of the storage tank 12 exceeds an upper threshold pressure. In this manner, vapor, fumes, and/or fluid may be vented from the storage tank 12, thereby decreasing the internal pressure of the storage tank 12. Once the internal pressure of the storage tank 12 falls below the upper threshold pressure, the pressure seal assembly of the gauge hatch 10 may automatically close and re-seal, thereby blocking fluid communication between the interior of the storage tank 12 and the ambient environment.

In some instances, pressure may decrease within the storage tank 12 to form a vacuum (e.g., a negative pressure relative to the ambient environment). For example, the output device may pump fluid from the storage tank 12, or a low ambient temperature may cause the pressure within the storage tank 12 to drop. In some examples, it may be desirable to reduce an excessive vacuum within the storage tank 12 by allowing fluid (e.g., air) from the ambient environment to be introduced into the interior of the storage tank 12 when the pressure is below a threshold pressure (e.g., a vacuum pressure threshold). As such, the gauge hatch 10 may include a vacuum seal assembly configured to open to allow fluid communication between the interior of the storage tank 12 and an ambient environment external to the storage tank 12, similar to that described above for excess pressure in the storage tank 12. Thus, in some examples, the gauge hatch 10 regulates the pressure within the storage tank 12 to be within upper and lower thresholds. In some examples, the gauge hatch 10 includes two different seal assemblies that cooperatively operate to selectively open or remain sealed at respective ones of the thresholds, limiting the operating range of pressures maintained within the storage tank 12. In each case, the seal assemblies typically use a compression or tension spring to urge a seal member against a seal surface.

As mentioned above, a problem encountered when using large, stiff compression springs in the pressure seal assembly is that it is difficult to close the lid due to the resistance of the compression spring. Because the lid is hinged to the base, another problem is that the seal member contacts the seal surface in a misaligned relationship, possibly damaging the seal member.

Figure 2:
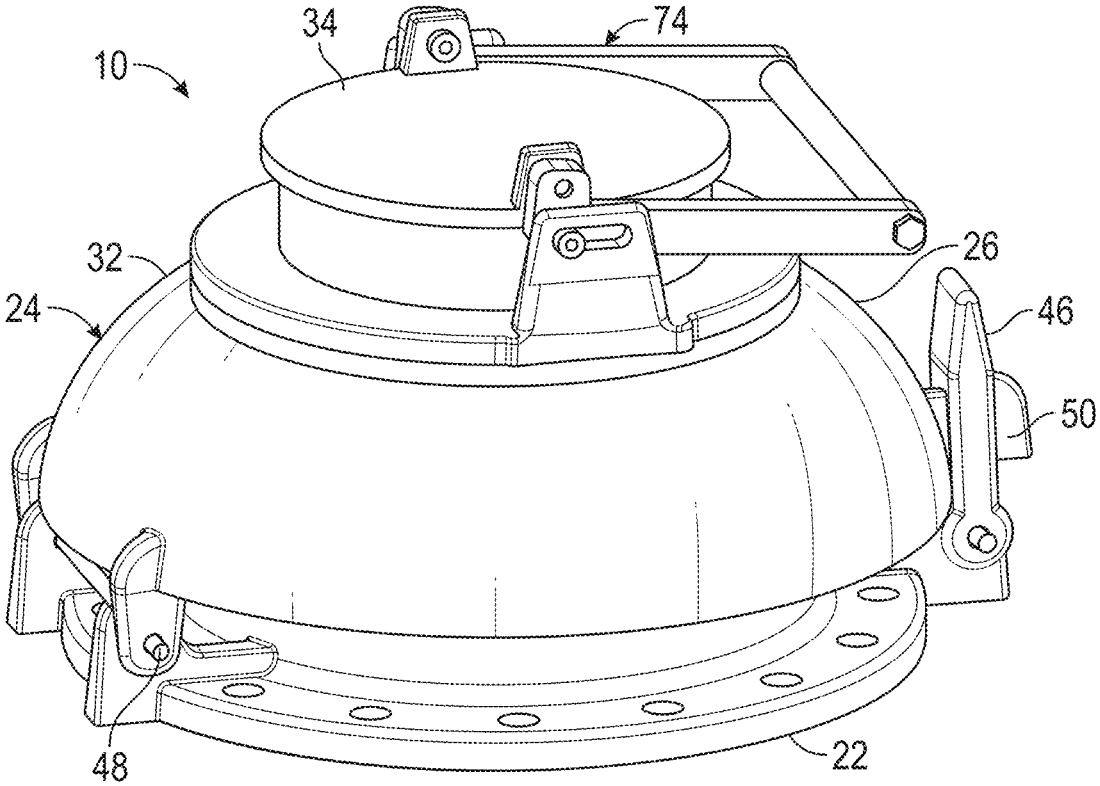
FIG. 2 is a perspective view of the gauge hatch shown in a first position.
Figure 3:
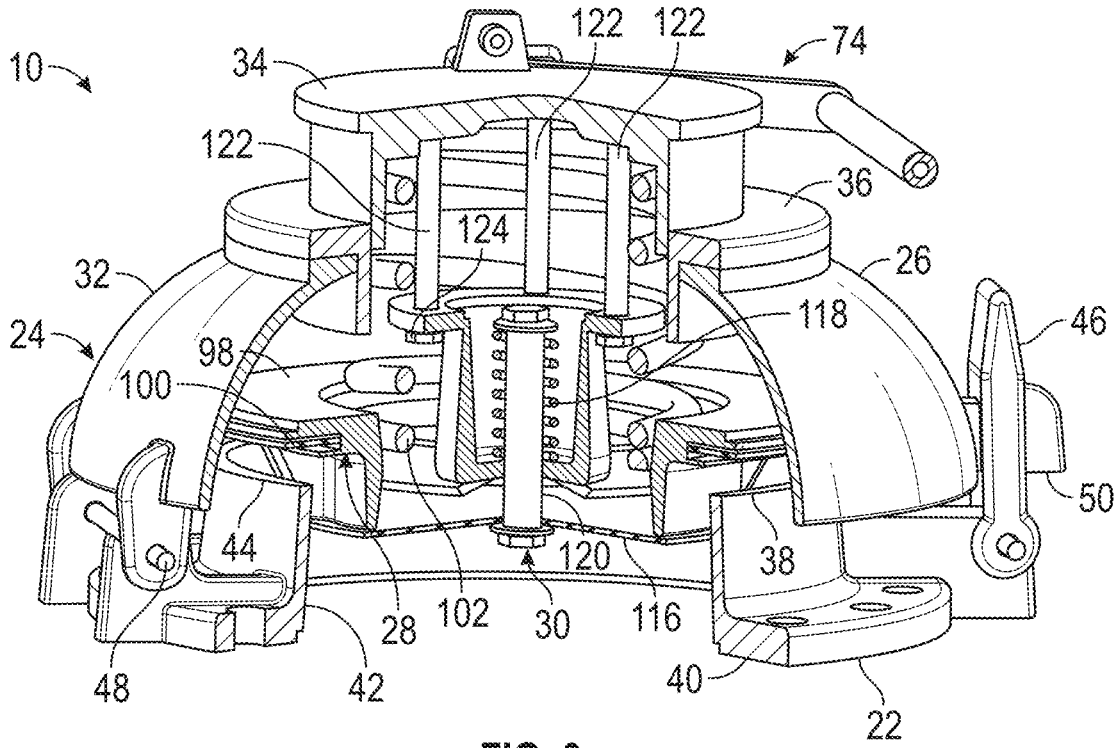
FIG. 3 is a cutaway, perspective view of the gauge hatch of FIG. 2.
Figure 4:
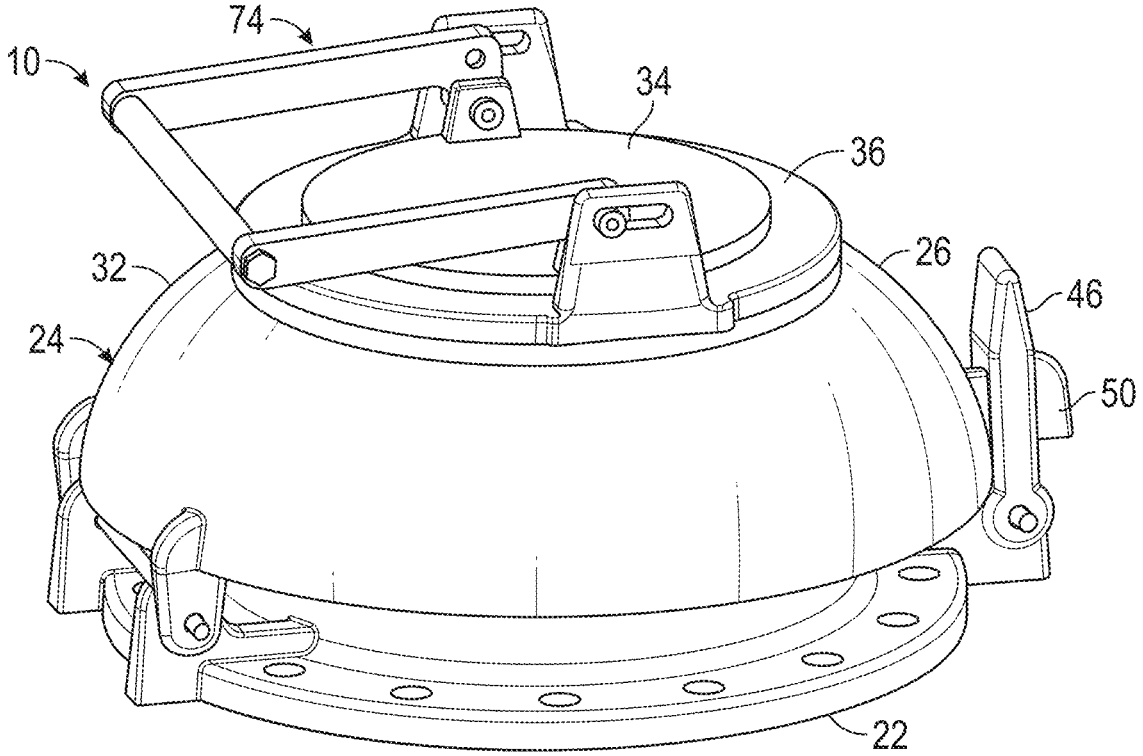
FIG. 4 is a perspective view of the gauge hatch shown in a second position.
Figure 5:
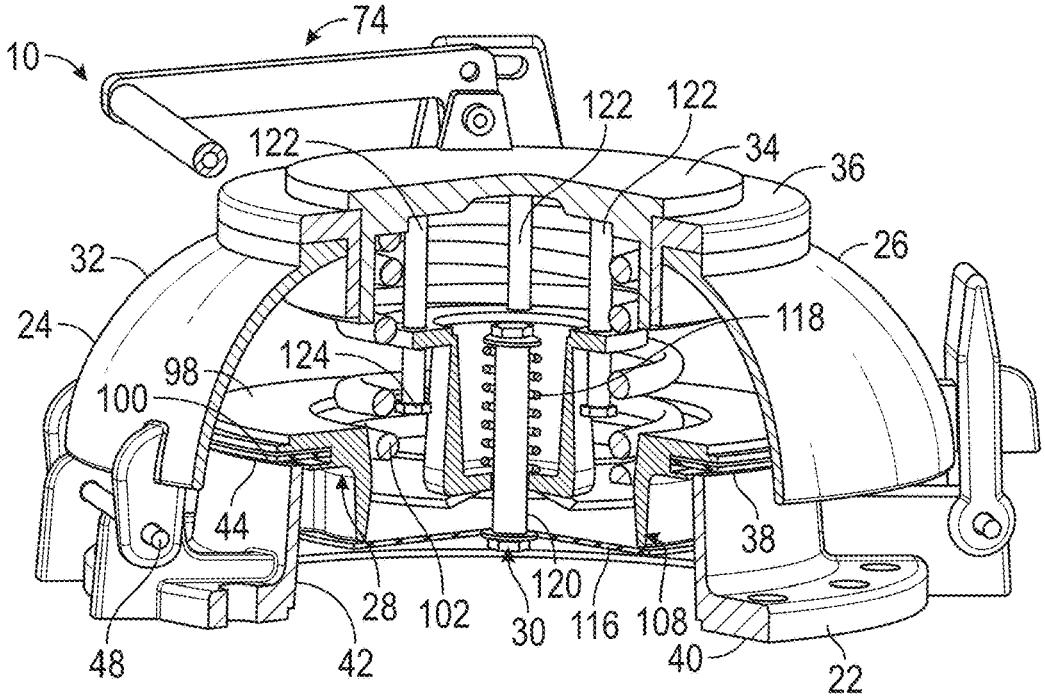
FIG. 5 is a cutaway, perspective view of the gauge hatch of FIG. 4.

Referring now to FIGS. 2-8, the gauge hatch 10 broadly includes a base 22 and a lid assembly 24 hinged to the base 22. The lid assembly 24 includes a lid 26, a pressure seal assembly 28 (FIGS. 3 and 5), and may include a vacuum seal assembly 30 (FIGS. 3 and 5). The lid 26 includes a body 32 and a pusher 34.

With reference to FIGS. 3 and 5, the base 22 is configured to be mounted to the storage tank 12 over the access opening of the storage tank 12. The base 22 has an upper end 38, a lower end 40, and an opening 42 extending therethrough from the upper end 38 to the lower end 40 to provide access to the storage tank 12. The lower end 40 may be in the form of a flange to facilitate the connection of the base 22 to the storage tank 12 with a plurality of fasteners, such as studs and nuts. The upper end of the base 22 has an annular surface that functions as a seal surface 44. The base 22 may have a latch 46 or some other securing device.

The lid assembly 24 is hinged to the base 22, so the lid assembly 24 is movable between an open position wherein the opening 42 of the base 22 is exposed to provide access to the storage tank 12 and a closed position wherein the opening 42 is covered. In one embodiment, the lid assembly 24 is hinged to the base 22 with a pin 48. The lid assembly 24 may have a catch 50 engageable with the latch 46 of the base 22 to secure the lid assembly 24 in the closed position.

Figure 6A:
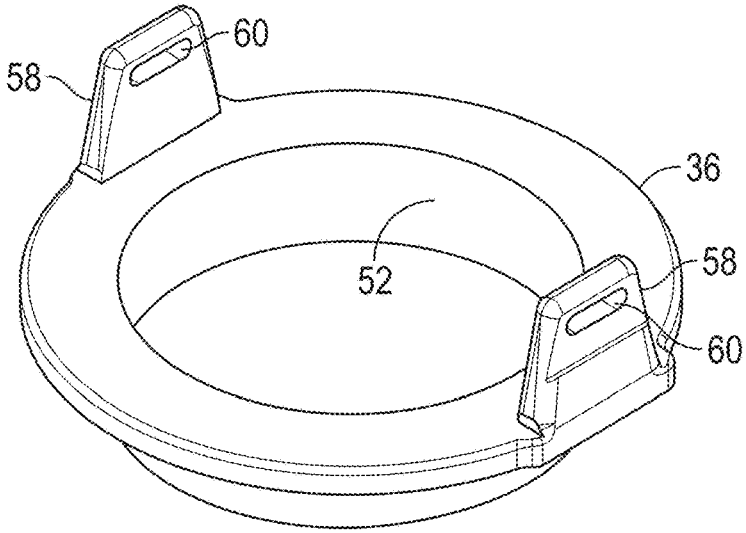
FIG. 6A is a perspective view of a sleeve portion of a lid.
Figure 6B:
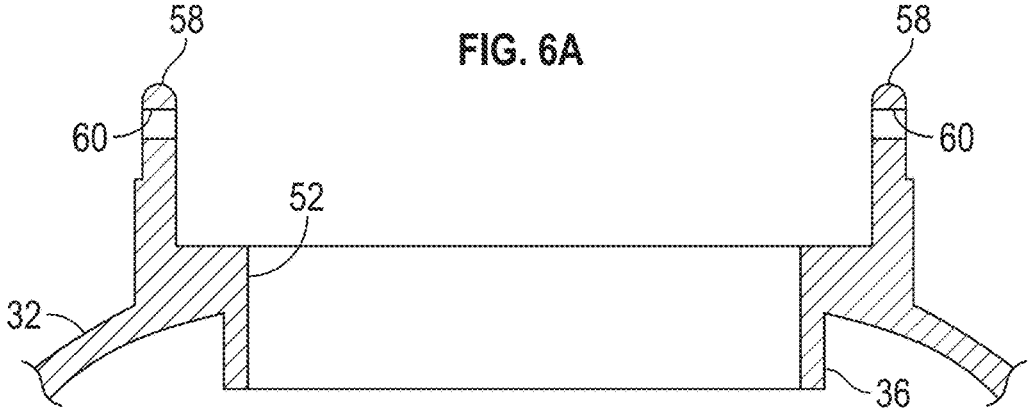
FIG. 6B is a cross-sectional view of another embodiment of a sleeve portion formed as one piece with the lid.
Figure 7A:
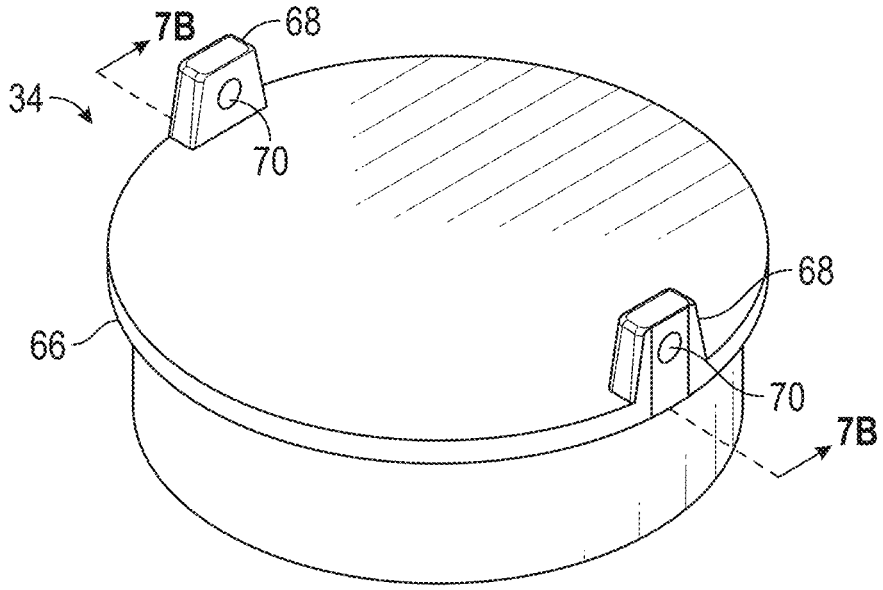
FIG. 7A is a perspective view of a pusher of the lid.
Figure 7B:
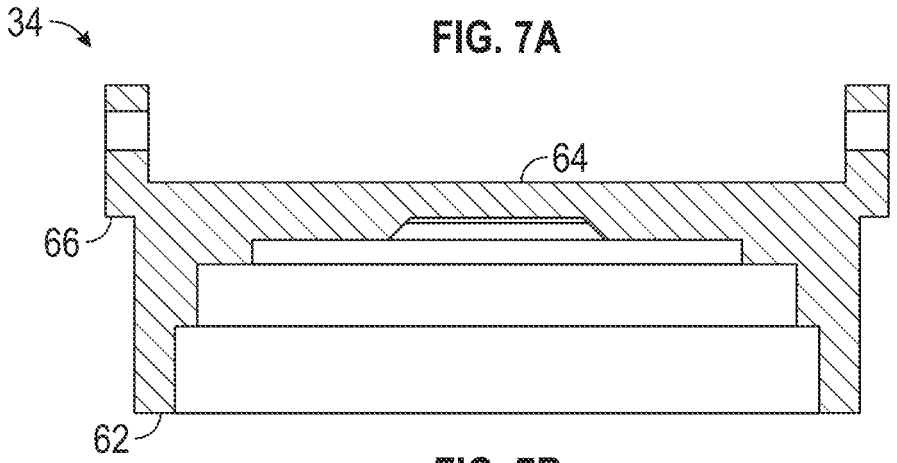
FIG. 7B is a cross-sectional view taken along line 7B-7B of FIG. 7A.
Figure 8A:
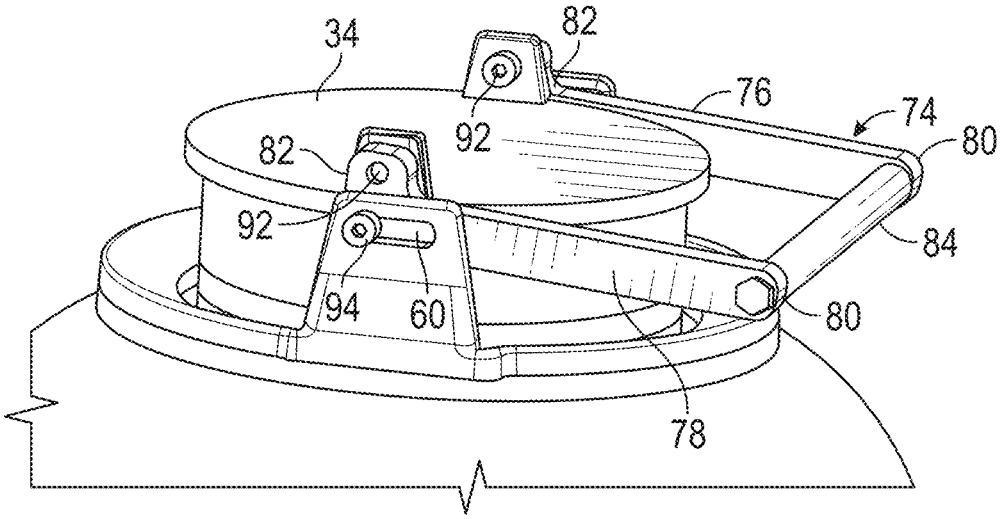
FIG. 8A is a perspective of the pusher and a lever assembly shown in the first position.
Figure 8B:
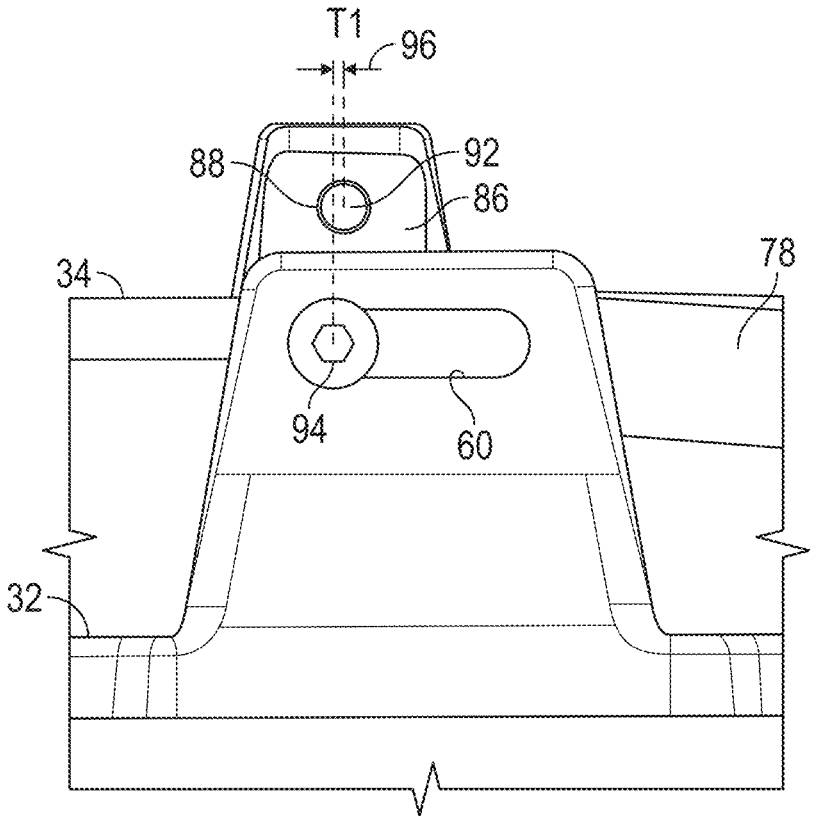
FIG. 8B is an elevational view of a portion of the pusher and the lever assembly of FIG. 8A.
Figure 8C:
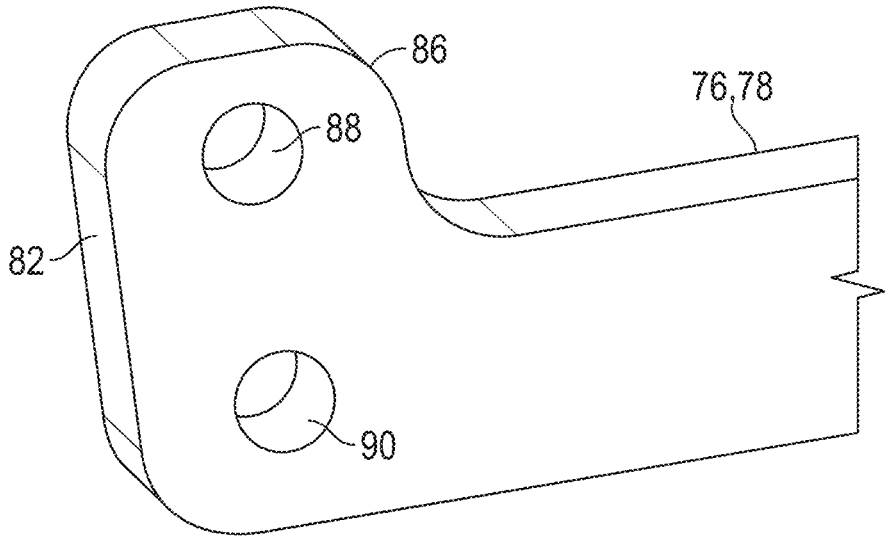
FIG. 8C is an enlarged, perspective view of a cam portion of a lever.

More particularly, the body 32 of the lid 26 is hinged to the base 22. Further, the body 32 has a central opening 52 for receiving the pusher 34. The body 32 is shown to be generally domed-shaped. However, it will be appreciated that it may be formed in any shape suitable to support the remainder of the lid assembly 24. The body 32 may have a sleeve portion 36 (FIGS. 6A and 6B) for axially guiding the pusher 34. The sleeve portion 36 is shown to be cylindrical, but it will be appreciated that the sleeve portion 36 can be formed in various shapes. It will also be appreciated that the sleeve portion 36 may be formed as a single unit with the body 32 (as shown in FIG. 6B), or the sleeve portion 36 may be formed as a separate component (as shown in FIGS. 3, 5, and 6A) that is integrated with the body 32 in a suitable fashion, such as by welding. The body 32 further has two ears 58 extending therefrom on opposing sides of the central opening 52. Each of the ears is provided with horizontal slots 60.

The pusher 34 is generally cup-shaped with an open end 62 and a closed end 64. A flange 66 extends from the closed end 64 of the pusher 34 to serve as a stop or limit member. The pusher 34 is mounted to the body 32 of the lid 26 in a way that the pusher 34 is movable between a first position (FIGS. 2, 3, 8A, and 8B) and a second position (FIGS. 4, 5, 10A, and 10B). In the first position, the pusher 34 is positioned upward or away from the body 32, so the flange 66 of the pusher 34 is spaced from the body 32. In the second position, the pusher 34 is positioned downward, so the flange 66 of the pusher 34 is engaged with the body 32. The pusher 34 has two ears 68 on opposing sides of the pusher 34 extending away from the closed end 64 of the pusher 34. Each of the ears 68 is provided with a hole 70.

Referring now to FIGS. 8A-10B, in one embodiment the pusher 34 may be moved between the first position and the second position with a lever assembly 74. The lever assembly 74 may use an over-center configuration. The lever assembly 74 may include a first lever 76 and a second lever 78. Each of the first lever 76 and the second lever 78 has a first end 80 and a second end 82. The first end 80 of the first lever 76 and the first end 80 of the second lever 78 are connected with a handle 84.

The second ends 82 of each of the first lever 76 and the second lever 78 have a cam portion 86 (FIG. 8C) with a first hole 88 and a second hole 90. The first hole 88 of each of the first lever 76 and the second lever 78 is aligned with the holes 70 of the pusher 34 of the lid 26 and pivotally connected thereto with a suitable fastener, such as a pin 92. The second holes 90 of the first end second levers 76, 78 are aligned with the horizontal slots 60 and pivotally connected to the body 32 with a suitable fastener, such as a pin 94, so the fastener is slidable along the horizontal slots 60.

Figure 9:
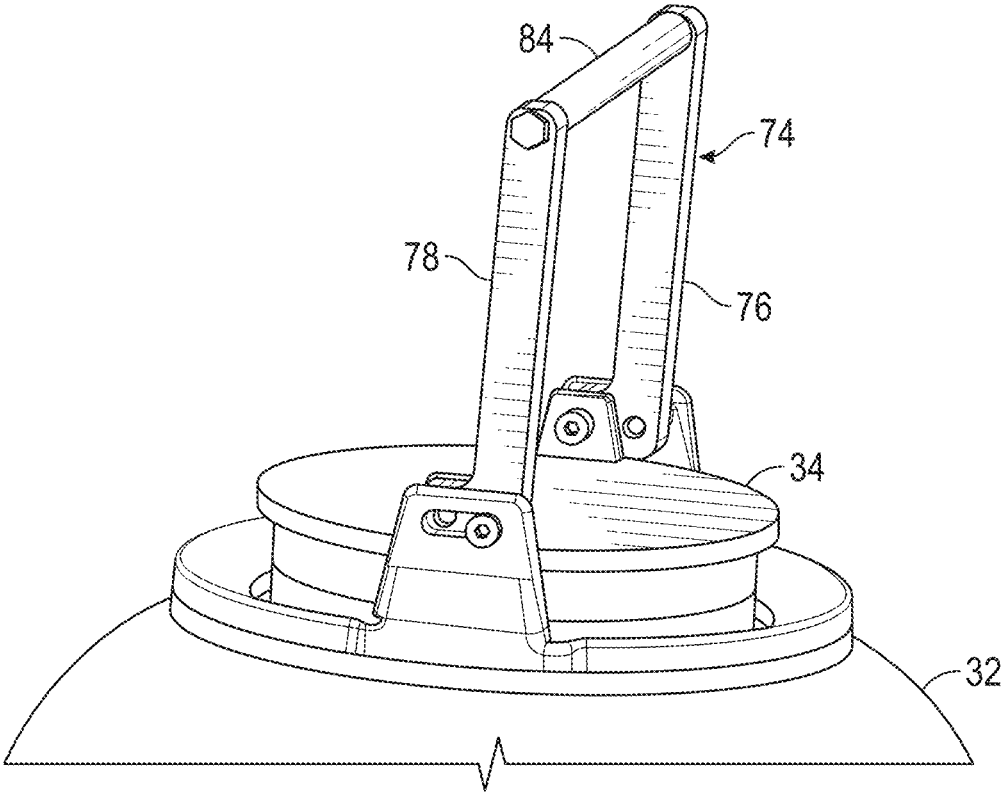
FIG. 9 is a perspective view of the pusher and the lever assembly shown in an intermediate position.
Figure 10A:
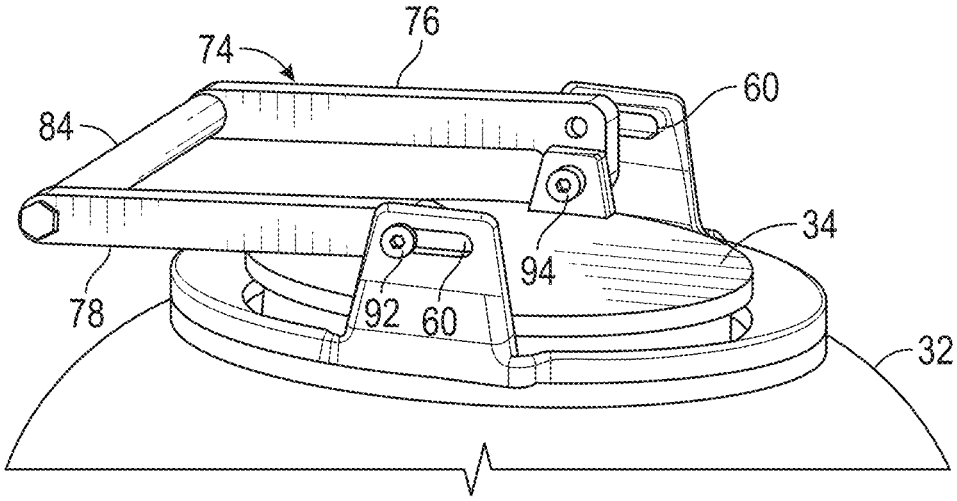
FIG. 10A is a perspective of the pusher and the lever assembly shown in the second position.
Figure 10B:
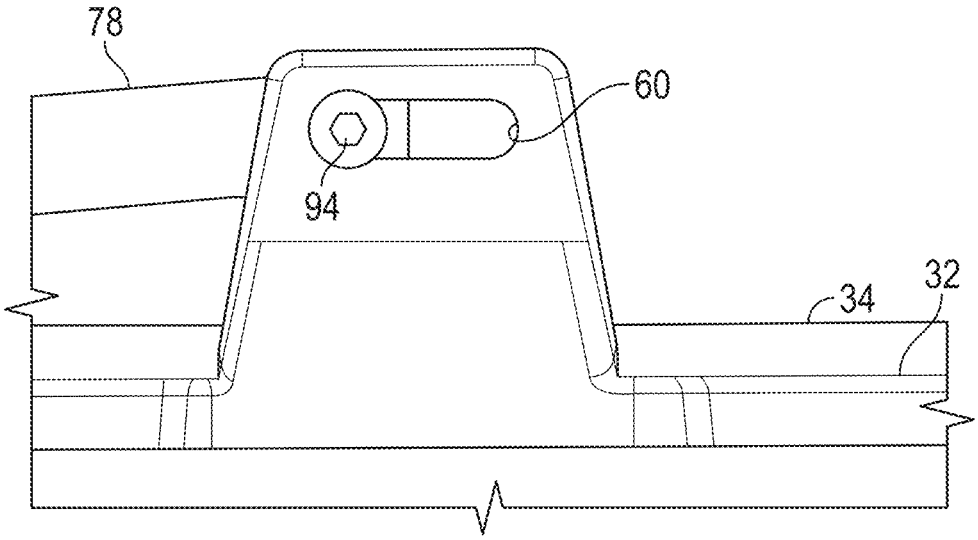
FIG. 10B is an elevational view of a portion of the pusher and the lever assembly of FIG. 10A.
Figure 11A:
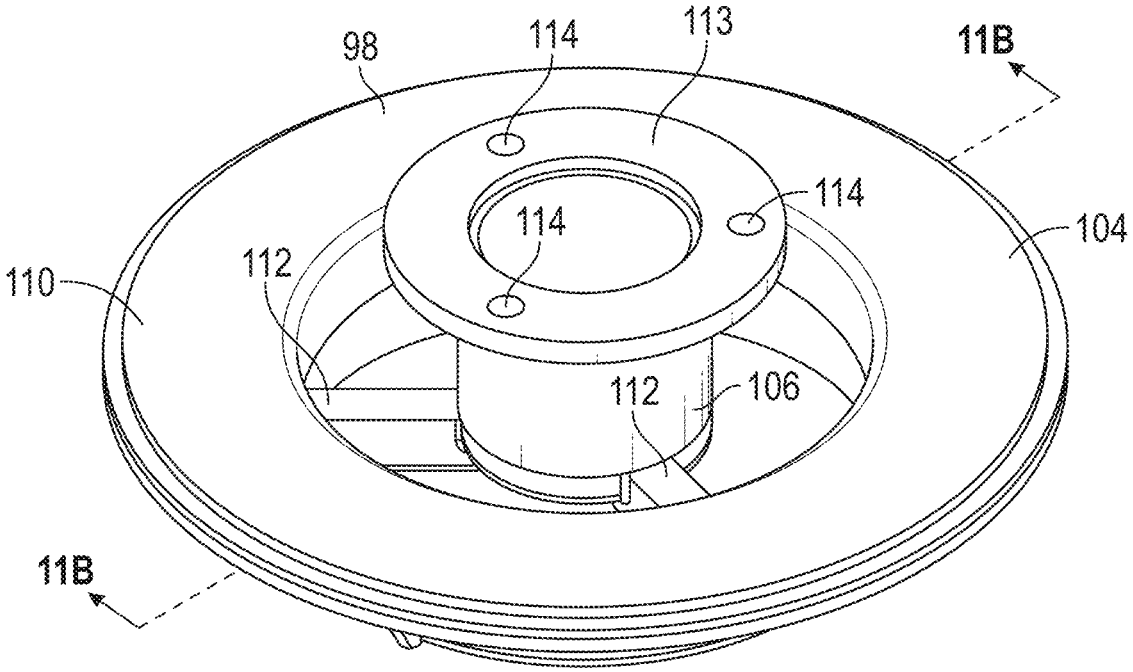
FIG. 11A is a perspective view of a plunger.
Figure 11B:
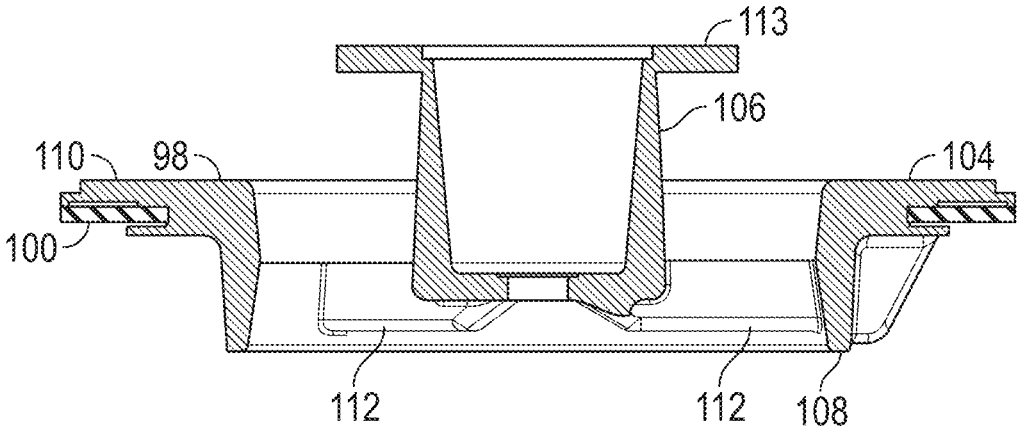
FIG. 11B is a cross-sectional view taken along line 11B-11B of FIG. 11A.

The first and second holes 88 and 90 of the first and second levers 76 and 78 are arranged, and the horizontal slots 60 are dimensioned such that the first holes 88 are vertically offset from the second holes 90 when the pusher 34 is in the first position (FIG. 8B) and the second position (FIG. 10B). The offset distance is referred to herein as a locking gap 96. In use, with the lever assembly 74 in a first lever position (FIGS. 8A and 8B), the lever assembly 74 is in an over-center position with the pusher 34 in the first position due to the locking gap 96, allowing the lever assembly 74 to move down past the horizontal. Upon actuation of the lever assembly 74 by lifting the handle 84 and causing the rotation of the first lever 76 and the second lever 78, the pins 94 positioned in the horizontal slots 60 are caused to slide to the opposite end of the horizontal slots 60 when the first and second levers 76 and 78 are in a vertical orientation or intermediate position (FIG. 9). The pins 94 return to the other end of the horizontal slots 60 as the movement of the first and second levers 76 and 78 continue to be rotated to a second lever position (FIGS. 10A and 10B) where again the lever assembly 74 moves down past the horizontal. The radial motion of the pins 94 is transferred to the pins 92 as linear motion through the cam portion 86. The pins 94 act as a floating fulcrum as they travel along the horizontal slots 60, allowing the pins 92 to travel in a perpendicular fashion. The horizontal slots 60 are created perpendicular to the desired motion of the pusher 34 of the lid 26, so the pusher 34 travels axially (i.e., perpendicularly) relative to the base 22.

Referring now to FIGS. 3, 5, 11A, and 11B, the pressure seal assembly 28 includes a plunger 98 positioned between the base 22 and the lid 26, a pressure seal member 100 supported by the plunger 98 so the pressure seal member 100 is sealingly engageable with the seal surface 44 of the base 22, and a pressure spring 102 (FIGS. 3 and 5) positioned between the lid 26 and the plunger 98 to urge the pressure seal member 100 against the seal surface 44 of the base 22.

The plunger 98 has a flange portion 104 and a hub portion 106. The flange portion 104 has a lower end with an annular seal surface 108 that functions as a seal surface in conjunction with the vacuum seal assembly 30. An upper end of the flange portion 104 has a flange 110 that supports the pressure seal member 100. The pressure seal member 100 is secured on the flange 110 of the plunger 98 such that when the lid assembly 24 is in the closed position and the plunger 98 is urged against the seal surface 44 of the base 22, the pressure seal member 100 creates a seal with the seal surface 44 of the base 22. The pressure seal member 100 may be an annular gasket formed of a suitable elastomeric material.

The sealing force for the pressure seal member 100 is generated by the pressure spring 102 being compressed between the lid 26 and the plunger 98 as will be described below. The pressure spring 102 has a strength or rating that causes the pressure seal 100 to disengage from the seal surface 44 of the base 22 when the pressure in the storage tank 12 is too high relative to the ambient pressure. More particularly, when the storage tank 12 pressure exceeds an upper threshold, the pressure seal member 100 disengages from the seal surface 44 to enable pressure within the storage tank 12 to pass between the pressure seal member 100 and the base 22 and then between the body 32 and the base 22 to the ambient environment exterior to the storage tank 12. Pressure springs may be used that vary in strength (e.g., from 4 oz. to 32 oz).

The hub portion 106 is supported relative to the flange portion 104 by a plurality of support members 112 spaced apart and extending radially from the hub portion 106 to the flange portion 104 to define a plurality of flow paths between the flange portion 104 and flange portion 104. The hub portion 106 may generally be cup-shaped to house the vacuum seal assembly 30. An upper end of the hub portion 106 may include a flange 113 provided with a plurality of apertures 114 (FIG. 11A) circumferentially spaced about the flange 113.

Referring to FIGS. 3 and 5, the vacuum seal assembly 30 is supported by the plunger 98 of the pressure seal assembly 28. The vacuum seal assembly 30 includes a vacuum seal member 116 that is urged against the seal surface 108 of the plunger 98. The sealing force for the vacuum seal member 116 may be generated by a vacuum spring 118 (e.g., tension spring) supported by a stem 120 positioned in the hub portion 106 of the plunger 98. The vacuum seal member 116 may be a gasket formed of a suitable elastomeric material and supported by a plurality of washers or plates in a manner known by those of ordinary skill in the art. The vacuum seal assembly 30 is secured to the plunger 98. Like the pressure spring 102, vacuum springs may be used that vary in strength, but the strength of the vacuum spring 118 typically is not deemed as critical as the strength of the pressure spring 102. It will be appreciated by those of ordinary skill in the art that there may be conditions that do not warrant the use of a vacuum seal assembly. In such instances, the vacuum seal assembly may be omitted and the plunger otherwise sealed or blocked off.

In use, the pressure spring 102 is secured between the lid 26 and the plunger 98, so the plunger 98 remains connected to the lid 26 when the lid 26 is in the open position. In one embodiment, the pusher 34 is provided with a plurality of guide rods 122 (FIGS. 3 and 5) that extend downwardly from the closed end of the pusher 34 and in a circumferentially spaced relationship to one another. A distal end of each of the guide rods 122 is slideably disposed through the apertures 114 formed through the flange of the hub portion 106 of the plunger 98. One end of the pressure spring 102 is positioned within the pusher 34 of the lid 26 against the closed end of the pusher 34 and the other end of the pressure spring 102 is positioned against the plunger 98. In one version, the pressure spring 102 is positioned between the flange portion 104 and the hub portion 106, with the end of the pressure spring 102 in contact with the support members 112 of the plunger 98.

A retaining nut 124 may be secured to the distal ends of the guide rods 122 to secure the plunger 98 to the pusher 34 of the lid 26, with the pressure spring 102 positioned therebetween. In some instances, the pressure spring 102 may be slightly or limitedly compressed to hold it against the pusher 34 when the lid assembly 24 is in the open position.

Figure 12:
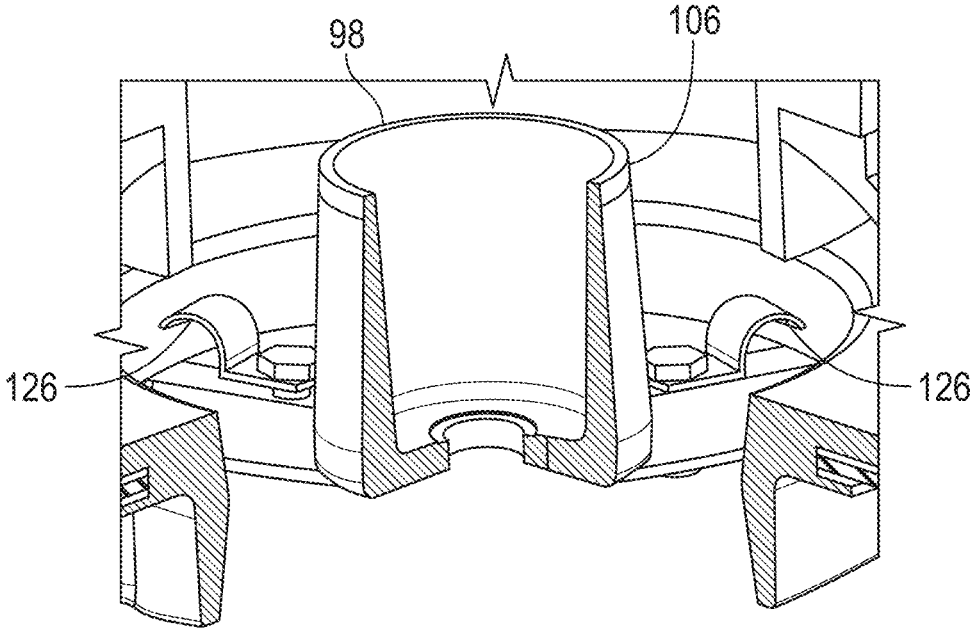
FIG. 12 is a cutaway, perspective of another embodiment of a plunger.

In another version and with reference to FIG. 12, the lower end of the pressure spring 102 may be secured to the plunger 98 with one or more fasteners, such as clips 126 (the pressure spring 102 and the vacuum seal assembly 30 are removed from FIG. 12 for clarity purposes). Similarly, the upper end of the pressure spring 102 may be secured to the pusher 34 with one or more fasteners similar to the clips 126 or by frictional engagement. With this version, it will be appreciated that the guide rods 122 and the flange 113 of the hub portion 106 may be eliminated.

With the pressure spring 102 secured between the lid 26 and the plunger 98 and the lid assembly 24 in the open position, movement of the pusher 34 relative to the body 32 from the first position to the second position merely causes the pressure spring 102 and the plunger 98 to move in an up and down direction without affecting the compression of the pressure spring 102. To move the lid assembly 24 to the closed position, the pusher 34 is positioned in the first position so the pressure spring 102 and the plunger 98 are in an up position wherein the pressure spring 102 is in a substantially non-compressed condition and the pressure seal member 100 is sealing disengaged from or otherwise spaced from the seal surface 44 of the base 22 as the lid assembly 24 is moved to the closed position (FIGS. 2 and 3). With the lid assembly 24 secured in the closed position, the actuation of the pusher 34 from the first position to the second position with the lever assembly 74 causes the pressure seal member 100 to engage the seal surface 44 of the base 22 and the pressure spring 102 to be compressed (FIGS. 4 and 5). In the compressed condition, the pressure spring 102 urges the pressure seal member 100 against the seal surface 44 of the base 22, so the pressure seal member 100 is sealingly engaged with the seal surface 44 of the base 22.

The lever assembly 74 enables the pressure spring 102 to be safely compressed and decompressed. Also, the axial movement of the pusher 34 of the lid 26 that is perpendicular to the seal surface 44 of the base 22 causes the pressure seal member 100 to uniformly engage the seal surface 44 of the base 22.

From the above description, it is clear that the inventive concepts disclosed and claimed herein are well adapted to carry out the objects and to attain the advantages mentioned herein, as well as those inherent in the invention. While exemplary embodiments of the inventive concepts have been described for purposes of this disclosure, it will be understood that numerous changes may be made that will readily suggest themselves to those skilled in the art and which are accomplished within the spirit of the inventive concepts disclosed and/or defined in the appended claims.

What is claimed is:

1. A gauge hatch for a storage tank, comprising:

a base attachable to the storage tank around an aperture in the storage tank, the base having an upper end, a lower end, and an opening extending therethrough from the upper end to the lower end to provide access to the storage tank, the upper end having an annular seal surface;

a lid hinged to the base wherein the lid is movable between an open position wherein the opening of the base is exposed to provide access to the storage tank and a closed position wherein the opening is covered;

a pressure seal assembly comprising a plunger positioned between the base and the lid and having a lower end with an annular seal surface, a pressure seal member supported by the plunger wherein the pressure seal member is sealingly engageable with the annular seal surface of the base, and a pressure spring positioned between the lid and the plunger;

a vacuum seal assembly supported by the plunger of the pressure seal assembly, the vacuum seal assembly comprising a vacuum seal member, wherein the vacuum seal member is sealingly engageable with the annular seal surface of the plunger, wherein the lid comprises a body and a pusher with the pressure spring positioned between the pusher and the plunger, the pusher movably mounted to the body wherein the pusher is movable relative to the body between a first position wherein the pressure seal is sealingly disengaged from the annular seal surface of the base and the pressure spring is in a substantially non-compressed condition, and a second position wherein the pressure seal member is sealingly engaged with the annular seal surface of the base and the pressure spring is in a compressed condition.

2. The hatch of claim 1, wherein the plunger moves perpendicularly relative to the annular seal surface of the base between the first position and the second position when the lid is in the closed position.

3. The hatch of claim 1, wherein the lid further comprises a lever assembly having a first portion pivotally connected to the body and a second portion pivotally connected to the pusher, the lever assembly movable between a first lever position wherein the pusher is in the first position and a second lever position wherein the pusher is in the second position.

4. The hatch of claim 1, wherein the pressure spring has a first end connected to the pusher and a second end connected to the plunger.

5. The hatch of claim 1, wherein the pusher is connected to the plunger.

6. The hatch of claim 1, further comprising a plurality of guide rods, each of the guide rods having a first end connected to the pusher and being slidably attached to the plunger.

7. A gauge hatch in combination with a storage tank having a top with an access opening, the gauge hatch comprising:

a base attached to the storage tank around the access opening in the storage tank, the base having an upper end, a lower end, and an opening extending therethrough from the upper end to the lower end to provide access to the storage tank, the upper end having an annular seal surface;

a lid hinged to the base wherein the lid is movable between an open position wherein the opening of the base is exposed to provide access to the storage tank and a closed position wherein the opening is covered;

a pressure seal assembly comprising a plunger positioned between the base and the lid and having a lower end with an annular seal surface, a pressure seal member supported by the plunger wherein the pressure seal member is sealingly engageable with the annular seal surface of the base, and a pressure spring positioned between the lid and the plunger;

a vacuum seal assembly supported by the plunger of the pressure seal assembly, the vacuum seal assembly comprising a vacuum seal member, wherein the vacuum seal member is sealingly engageable with the annular seal surface of the plunger, wherein the lid comprises a body and a pusher with the pressure spring positioned between the pusher and the plunger, the pusher movably mounted to the body wherein the pusher is movable relative to the body between a first position wherein the pressure seal is sealingly disengaged from the annular seal surface of the base and the pressure spring is in a substantially non-compressed condition, and a second position wherein the pressure seal member is sealingly engaged with the annular seal surface of the base and the pressure spring is in a compressed condition.

8. The combination of claim 7, wherein the plunger moves perpendicularly relative to the annular seal surface of the base between the first position and the second position when the lid is in the closed position.

9. The combination of claim 7, wherein the lid further comprises a lever assembly having a first portion pivotally connected to the body and a second portion pivotally connected to the pusher, the lever assembly movable between a first lever position wherein the pusher is in the first position and a second lever position wherein the pusher is in the second position.

10. The combination of claim 7, wherein the pressure spring has a first end connected to the pusher and a second end connected to the plunger.

11. The combination of claim 7, wherein the pusher is connected to the plunger.

12. The combination of claim 7, further comprising a plurality of guide rods, each of the guide rods having a first end connected to the pusher and being slidably attached to the plunger.

13. A lid assembly for a gauge hatch, comprising:

a lid hingedly connectable to a base having an opening extending therethrough and an annular seal surface wherein the lid is movable between an open position wherein the opening of the base is exposed and a closed position wherein the opening is covered;

a pressure seal assembly comprising a plunger positioned between the base and the lid when the lid is hingedly connected to the base and having a lower end with an annular seal surface, a pressure seal member supported by the plunger wherein the first seal member is sealingly engageable with the annular seal surface of the base, and a pressure spring positioned between the lid and the plunger;

a vacuum seal assembly supported by the plunger of the pressure seal assembly, the vacuum seal assembly comprising a vacuum seal member, wherein the vacuum seal member is sealingly engageable with the annular seal surface of the plunger, wherein the lid comprises a body and a pusher with the pressure spring positioned between the pusher and the plunger, the pusher movably mounted to the body wherein the pusher is movable relative to the body between a first position wherein the pressure seal is sealingly disengaged from the annular seal surface of the base and the pressure spring is in a substantially non-compressed condition, and a second position wherein the pressure seal member is sealingly engagable with the annular seal surface of the base and the pressure spring is in a compressed condition when the lid is in the closed position.

14. The lid assembly of claim 13, wherein the plunger moves perpendicularly relative to the annular seal surface of the base between the first position and the second position when the lid is in the closed position.

15. The lid assembly of claim 13, wherein the lid further comprises a lever assembly having a first portion pivotally connected to the body and a second portion pivotally connected to the pusher, the lever assembly movable between a first lever position wherein the pusher is in the first position and a second lever position wherein the pusher is in the second position.

16. The lid assembly of claim 13, wherein the pressure spring has a first end connected to the pusher and a second end connected to the plunger.

17. The lid assembly of claim 13, wherein the pusher is connected to the plunger.

18. The lid assembly of claim 13 further comprising a plurality of guide rods, each of the guide rods having a first end connected to the pusher and being slidably attached to the plunger.

* * * * *